United States Patent [19]

van Lit

[11] 4,254,899

[45] Mar. 10, 1981

[54] SELF-ALIGNING AEROSOL DISPENSING DEVICE

[75] Inventor: Klaas J. van Lit, Amstelveen, Netherlands

[73] Assignee: S. C. Johnson & Son, Inc., Racine, Wis.

[21] Appl. No.: 87,195

[22] Filed: Oct. 22, 1979

[51] Int. Cl.[3] ..... B65D 83/14

[52] U.S. Cl. ..... 222/402.13; 222/182

[58] Field of Search ..... 222/182, 402.1, 402.13, 222/402.21, 402.22, 402.23

[56] References Cited

U.S. PATENT DOCUMENTS

| | | | |
|---|---|---|---|
| 3,058,626 | 10/1962 | Hibbs et al. | 222/182 |
| 3,407,975 | 10/1968 | Schroeder | 222/402.13 |
| 3,589,570 | 6/1971 | Gach | 222/402.13 |
| 3,674,184 | 7/1972 | Ewald | 222/182 X |
| 3,738,541 | 6/1973 | Greenebaum | 222/402.1 |
| 4,132,333 | 1/1979 | Debard | 222/402.13 |

*Primary Examiner*—Robert J. Spar
*Assistant Examiner*—Fred A. Silverberg

[57] ABSTRACT

A self-aligning overcap and button for aerosol containers including a button having a side surface terminating upwardly in a cylindrical wall surrounding a recessed upper surface which includes two helical ramps extending in opposite directions from a well adjacent to the wall to meet in a substantially radial edge diametrically opposite the well, and an overcap for engagement with the button, the overcap having a pointed alignment pin extending from the underside of an actuator tab and in position for engagement with the ramps and dimensioned for free insertion into the well in the button. Rotational alignment of the overcap and the button are accomplished under the force of gravity. In preferred embodiments the cylindrical wall of the button has an upper edge defining a plane substantially perpendicular to the axis of the button. In other preferred embodiments the actuator tab includes a cylindrical guide-sleeve dimensioned to receive the button.

9 Claims, 7 Drawing Figures

SELF-ALIGNING AEROSOL DISPENSING DEVICE

This invention relates to the field of dispensing fluids from pressurized containers and more particularly to a self-aligning overcap and button assembly for aerosol containers.

BACKGROUND OF THE INVENTION

In the aerosol industry, overcaps of the type which engage and operate valve buttons have been widely used for a period of several years. Such overcaps improve the appearance of the aerosol container, allow incorporation of tamper-proof devices and/or safety devices, guide the consumer in his use of the can, and facilitate stacking of the aerosol containers. The overcap usually has a shape indicating the direction in which the aerosol contents are to be sprayed and physical characteristics such as a window exposing the spray orifice to accommodate spraying. Such overcaps, therefore, must be rotationally aligned with the aerosol spray button.

In some cases the overcap and button are integrally molded to eliminate any need for concern regarding alignment. In other cases, the overcap and button are locked together prior to being mounted on the aerosol container. In still other cases an overcap is placed over the button and secured to the container after the button has been attached to the aerosol valve stem. The present invention applies to overcap and button combinations of the latter type. In such devices the overcap has an actuator tab which engages the button and which is used to depress or tilt the button (and thus the valve stem) for spraying.

A number of devices and methods for placing an overcap over an aerosol spray button and aligning the overcap with the button have been described and used in the prior art, including those disclosed in U.S. Pat. Nos. 3,674,184, 3,589,570, 3,738,541, 3,407,975, and 4,132,333. Devices and methods of the prior art, however, have had significant problems which the present invention is intended to solve, by providing a functionally superior, self-aligning, aerosol dispensing device of the overcap and button type.

The overcap and button typically have cooperating means which maintain the proper relative rotational alignment once such proper alignment is attained. The cooperating means usually consist of a key and a keyway formed in the adjacent surfaces of the button and overcap although other means can be used. Certain devices of the prior art include inclined ledges or ramps formed in the element having the keyway, such ledges or ramps being engageable by the key so as to allow or produce relative rotation of the button and overcap to bring them into the proper alignment.

Some overcap and button combinations of the prior art have drawbacks in that they require special assembly equipment to properly place the overcap on the button and/or to rotate the overcap with respect to the button to achieve the necessary alignment. Even though some of the devices of the prior art are intended to come into alignment by a relative rotating motion under the force of gravity, such action often fails because of improper placement of the overcap on the button or other interference preventing sufficient relative rotation to achieve alignment.

A specific problem is the periodic failure of gravitational alignment in prior art devices of the type having a button with slanted peripheral top surface which provides a slanted camming surface for engagement by a key of the corresponding overcap. Such failures occur, unless special assembly equipment is used, due to the occasional failure of the key to engage the slanted camming surface. Rather than engaging the camming surface, the key sometimes engages the side wall of the button thus preventing the necessary relative rotational movement.

Another problem is failure of alignment due to dimensional variations, burrs, and the like. In the key-keyway systems of the prior art, variations can cause a failure of proper cooperating engagement which prevents the intended aligning motion.

In summary, there is a need in the aerosol packaging industry for an overcap-button device which is reliably self-aligning, and which can come into alignment without the need for special assembly equipment.

BRIEF SUMMARY OF THE INVENTION

The present invention provides a novel aerosol dispensing device of the type including an overcap and a button which must come into alignment on the aerosol container. The self-aligning overcap and button of this invention include an overcap and button configured to cooperate in a particular manner. The button has a side surface terminating upwardly in a cylindrical wall surrounding a recessed upper surface which includes two helical ramps extending in opposite directions along the wall from a well adjacent to the wall to meet in a substantially radial edge diametrically opposite said well. The overcap has an actuator tab having a pointed alignment pin extending therefrom parallel to the axis of the overcap and button, in position for engagement with the ramps, and dimensioned for free insertion into the well. When the overcap is placed on the button, the alignment pin engages one of the helical ramps and under the force of gravity rotationally aligns itself with respect to the button.

The cylindrical wall of the button preferably has an upper edge defining a plane which is substantially perpendicular to the button axis. The helical ramps are preferably at an angle of at least 20°, and most preferably at least 30°, to a plane perpendicular to the axis. The well formed in the button is preferably an axially parallel opening through the button.

In preferred embodiments, the tab of the overcap includes an axially aligned cylindrical guide-sleeve on its lower side which is dimensioned to receive the button. In such embodiments the alignment pin is contained within the guide-sleeve. In such embodiments, the guide-sleeve preferably defines a window which is centered at a position diametrically opposite the location of the alignment pin. This window serves to expose the button for spraying.

OBJECTS OF THE INVENTION

It is an object of this invention to provide an aerosol dispensing device which overcomes the aforementioned problems of the prior art.

Another object of this invention is to provide an aerosol dispensing device of the type including an overcap and aerosol spray button which are reliably self-aligning.

Another object of this invention is to provide an aerosol dispensing device of the type including an overcap and button which will be readily self-aligned under the force of gravity without concern for the precise manner of placement of the overcap on the button.

Still another object of this invention is to provide a simple and inexpensive aerosol dispensing device of the type including a button and overcap which can reliably be assembled and automatically aligned without the need for special assembly equipment.

These and other important objects of the invention will become apparent from the following descriptions and from the drawings of preferred embodiments wherein:

DESCRIPTION OF PREFERRED EMBODIMENTS

Figure 1:
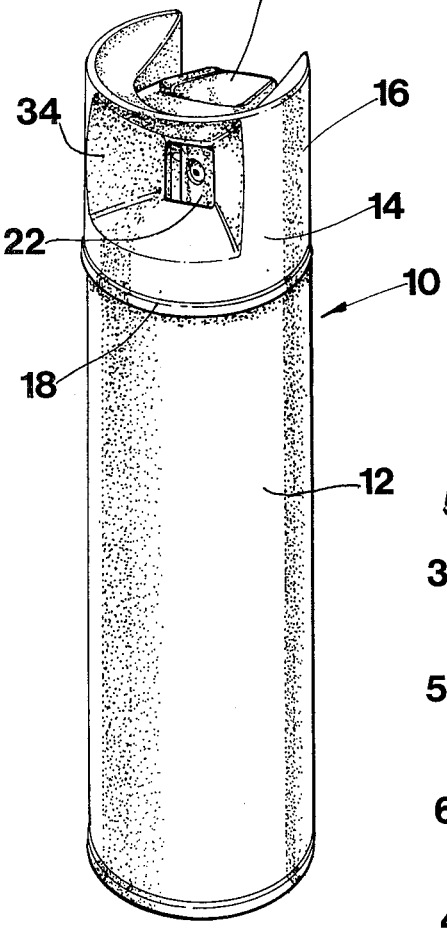
FIG. 1 is a perspective view of an aerosol container including an aerosol dispensing device in accordance with this invention.

FIG. 1 illustrates an aerosol package 10 which includes a conventional cylindrical pressurized can 12 and a dispensing device 14 in accordance with this invention. Dispensing device 14 includes an overcap 16 attached to can 12 and an aerosol spray button 22 frictionally engaged with an aerosol valve stem (not shown) which protrudes from can 12 along the axis of cylindrical can 12. Overcap 16 is snapped to a typical aerosol container dome (not shown) at a position near doubleseam 18 by inward projections 20, shown in FIG. 2, which engage an undercut in the dome.

Figure 2:
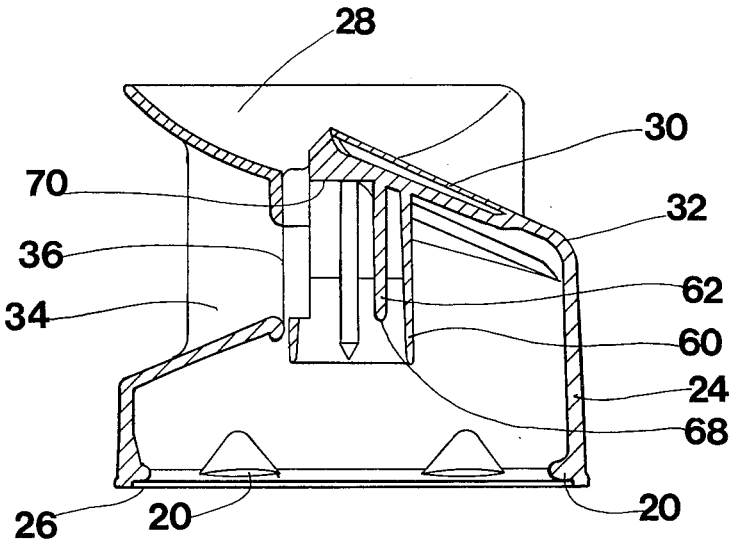
FIG. 2 is an enlarged side sectional view of the aerosol dispensing device shown in FIG. 1 (with the button removed), taken along section 2—2 as indicated in FIG. 3.
Figure 3:
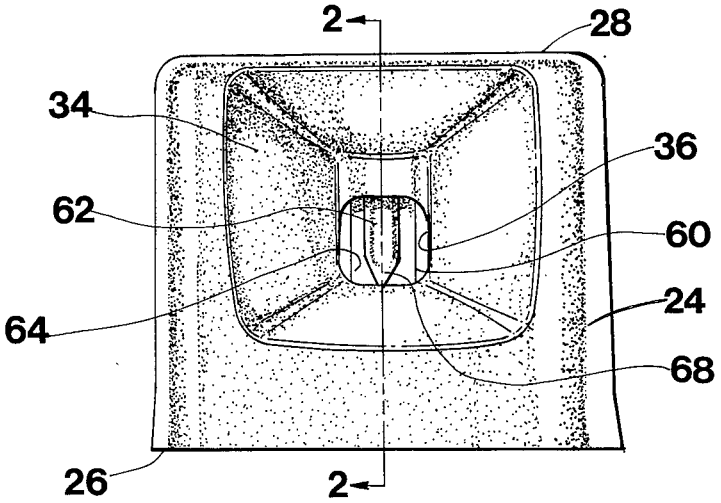
FIG. 3 is a front elevation of the device shown in FIG. 2.

Overcap 16, as illustrated best in FIGS. 2 and 3, includes a main sidewall 24 which is generally cylindrical and approximately of the same diameter as can 12. Sidewall 24 terminates downwardly in a lower edge 26 from which inward projections 20 protrude. Overcap 16 also includes a top wall 28. Top wall 28 includes an actuator tab 30 which is hinged to sidewall 24 by hinge 32 and may be depressed to depress spray button 22 and actuate the aerosol valve.

Sidewall 24 includes a recessed portion 34 which defines a window 36 through which button 22 is exposed after button 22 and overcap 16 have been assembled on can 12. The appearance of recessed portion 34 and actuator tab 30, as well as nonfunctional characteristics of the overcap design, give a directional impression to dispensing device 14 which aids in its use by the consumer.

Figure 4:
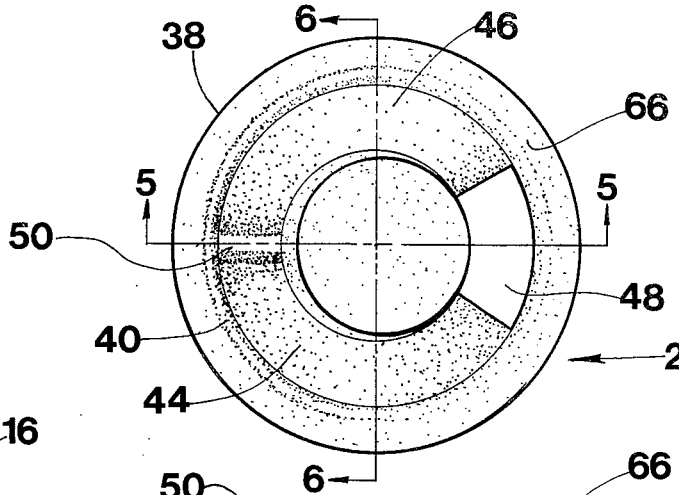
FIG. 4 is an enlarged top view of the button element of the device shown in FIG. 1.
Figure 5:
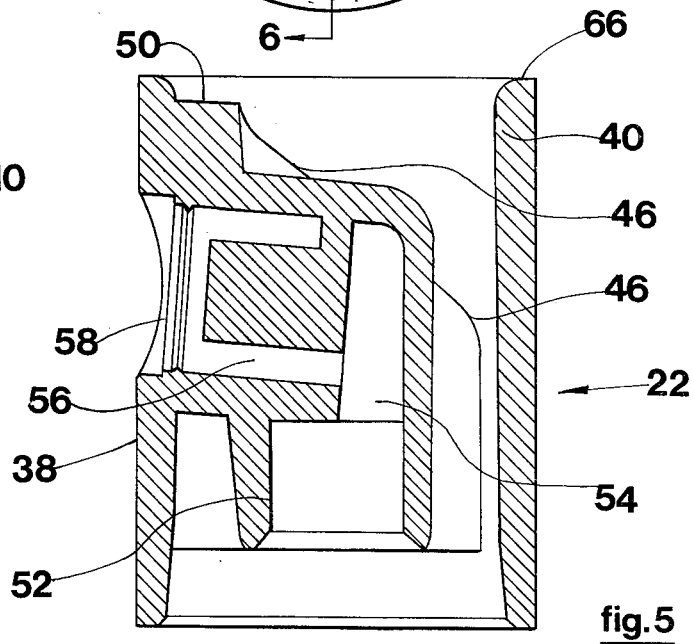
FIG. 5 is a side sectional view of FIG. 4, taken along section 5—5 as indicated in FIG. 4.
Figure 6:
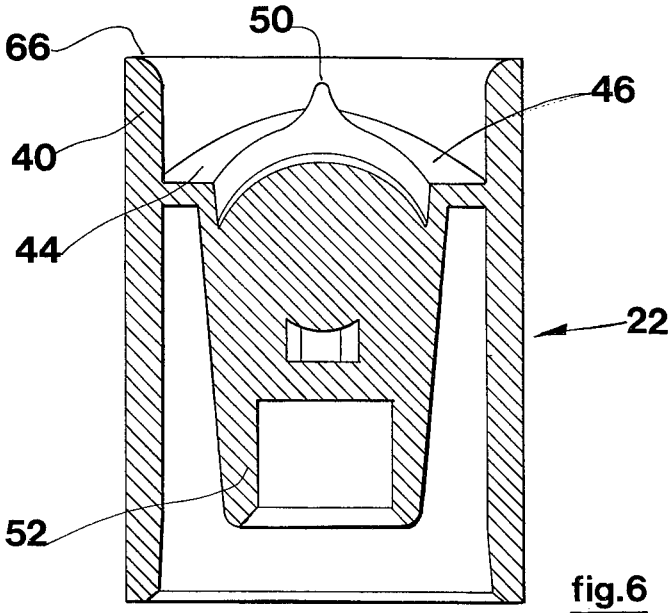
FIG. 6 is another sectional view of the device of FIG. 4, taken along section 6—6 as indicated in FIG. 4.

FIGS. 4, 5, and 6 illustrate the details of actuator button 22. Button 22 includes a generally cylindrical side surface 38 which defines an axis coincident with the axis of overcap 16, the axis of cylindrical can 12, and the axis of the aerosol valve stem protruding therefrom. Cylindrical side surface 38 terminates upwardly in a cylindrical wall 40 which surrounds a recessed upper surface 42 of spray button 22. Recessed upper surface 42 includes helical ramps 44 and 46 which extend in opposite directions along the inside of cylindrical wall 40. Spray button 22 defines a well 48 which is an axially parallel opening or hole through button 22 inside of and immediately adjacent to cylindrical wall 40. Helical ramps 44 and 46 extend from well 48 in opposite directions along cylindrical wall 40 to meet in a substantially radial edge 50 which is located in a position diametrically opposite to the position of well 48.

Button 22 also includes a stem-connecting sleeve 52 which is frictionally engaged with the valve stem when the button is assembled therewith. Button 22 defines an internal axial passageway 54 intended for fluid communication with the valve stem and a radial passageway 56 extending from axial passageway 54 to a laterally directed spray orifice 58.

Actuator tab 30 includes, on its lower side, an axially aligned cylindrical guide-sleeve 60 which is dimensioned to loosely receive spray button 22 as overcap 16 is assembled therewith. An alignment pin 62 is formed with actuator tab 30 on its lower side and extends therefrom within guide-sleeve 60 in an axially parallel direction. Alignment pin 62 terminates in a point 68 intended for engagement with helical ramps 44 or 46 and for insertion into well 48 when overcap 16 reaches proper rotational alignment with spray button 22. Guide-sleeve 60 defines a window 64 at a position diametrically opposite to the radial position of alignment pin 62. When overcap 16 and spray button 22 are in proper alignment, spray button 22 is exposed laterally through window 64 of guide-sleeve 60 as well as window 36 in recessed portion 34 of overcap 16.

Cylindrical wall 40 of spray button 22 terminates upwardly in an upper edge 66 defining a plane which is substantially perpendicular to the axis of button 22. By virtue of the location and perpendicular orientation of upper edge 66, overcap 16 and more specifically its guide-sleeve 60 can be reliably placed onto spray button 22 without the need for special assembly equipment. This configuration results in accurate placement such that point 68 of alignment pin 62 will engage helical ramp 44, helical ramp 46, or well 48 in its initial contact with spray button 22. This allows proper interaction of overcap 16 with button 22 under the force of gravity as required to achieve the proper rotational alignment.

As best illustrated in FIGS. 5 and 6, helical ramps 44 and 46 are preferably at an angle of at least 20°, and most preferably at an angle of at least 30°, to a plane perpendicular to the axis of button 22. This allows easy and quick rotational self-alignment of overcap 16 with button 22.

In operation, spray button 22 is already assembled with the aerosol valve stem when it comes to the point in the aerosol line where overcap 16 will be assembled therewith. Using normal assembly equipment, overcap 16 is placed on button 22 without regard to the relative rotational positions of overcap 16 and button 22. In most cases, point 68 of alignment pin 62 will engage button 22 on one of the helical ramps 44 or 46 and under the force of gravity will ride down such ramp surface causing relative rotational alignment of overcap 16 with button 22 until alignment pin 62 drops into well 48 as overcap 16 reaches the proper alignment with button 22. In some cases, alignment pin 62 will be inserted directly into well 48, in which case no relative rotational movement would be necessary. In a few cases, point 68 will first contact button 22 at radial edge 50. However, it is virtually impossible for overcap 16 to become "hung up" in such cases because normal line movements and vibrations, no matter how insignificant, will cause point 68 of alignment pin 62 to fall from radial edge 50 to one of the helical ramps 44 and 46, which will cause the necessary self-aligning rotational movement.

Actuator tab 30, as shown best in FIG. 2, has a lower surface portion 70 for engagement with upper edge 66 of spray button 22. After assembly the aerosol valve will be actuated by the application of downward axial finger pressure on actuator tab 30 the lower surface 70 of which will engage upper edge 66 of button 22 and thereby depress button 22 to actuate the aerosol valve. The return bias of the aerosol valve itself will allow spray button 22 and tab 30 to move in an axially upward direction when finger pressure is removed from tab 30.

Figure 7:
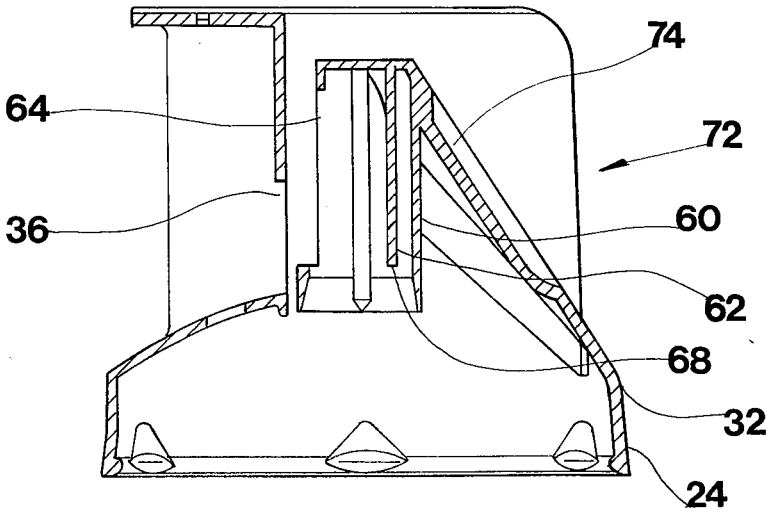
FIG. 7 is a side sectional view of the overcap of another embodiment of this invention, an embodiment for use with tilt valves.

FIG. 7 illustrates an overcap 72 which is an element of another embodiment of this invention useful with tilt-actuated aerosol valves. As may be noted from the numbering in FIG. 7, the critical elements of overcap 72 are structurally and functionally similar to the elements of overcap 16. The difference is that actuator tab 74 extends from its hinge along a line more nearly vertical than the line of actuator tab 30 as seen in FIG. 2. By virtue of this orientation, overcap 72 can be used with a tilt valve. In operation, actuator tab 74 will be moved (more laterally than downwardly) to tilt the button which in turn tilts the valve stem and actuates the valve.

The overcaps used in this invention are preferably integrally molded of plastic material such as high density polyethylene, polypropylene, or any of a variety of other plastic materials well known to those skilled in the art. The spray buttons used in this invention are also preferably molded in plastic. Suitable materials and variations in size and shape will be apparent to those skilled in the art who are familiar with this invention.

While in the foregoing specification, this invention has been described in relation to certain preferred embodiments and many details have been set forth for purpose of illustration, it will be apparent to those skilled in the art that the invention is susceptible to additional embodiments and that certain of the details described herein can be varied considerably without departing from the basis principles of the invention.

I claim:

1. A self-aligning overcap and button device for an aerosol container comprising:

a button having a recessed upper surface, and a substantially cylindrical wall surrounding the recessed upper surface and defining an axis, said upper surface defining a well adjacent to the wall and including two helical ramps extending from the well upwardly in opposite directions along the wall to meet in a substantially radial edge, said well and said edge being in diametrically opposite positions, and an overcap with an actuator tab having a pointed alignment pin extending therefrom substantially parallel to the axis and in position for engagement with said ramps and dimensioned for free insertion into said well, whereby the overcap, when placed on the button, will rotationally align itself with respect to the button under the force of gravity.

2. The device of claim 1 wherein the cylindrical wall has an upper edge defining a plane which is substantially perpendicular to the axis.

3. The device of claim 1 wherein the helical ramps are at an angle of at least 20° to a plane perpendicular to the axis.

4. The device of claim 3 wherein the helical ramps are at an angle of at least 30° to a plane perpendicular to the axis.

5. The device of claim 1 wherein the button defines an axially parallel opening therethrough to form said well.

6. The device of claims 3, 4 or 5 wherein the cylindrical wall has an upper edge defining a plane which is substantially perpendicular to the axis.

7. The device of claim 1 wherein the tab includes an axially aligned cylindrical guide-sleeve on the lower side thereof and dimensioned to receive the button, the pin being within the guide-sleeve.

8. The device of claim 7 wherein the guide-sleeve defines a window centered at a position diametrically opposed to the location of the pin.

9. The device of claims 7 or 8 wherein the cylindrical wall has an upper edge defining a plane which is substantially perpendicular to the axis.

* * * * *